US007868263B2

(12) United States Patent
Hammerstingl et al.

(10) Patent No.: US 7,868,263 B2
(45) Date of Patent: Jan. 11, 2011

(54) PERCUSSION HAND-HELD POWER TOOL WITH CONTACTLESS MANUAL SWITCH LOCATED IN SIDE HANDLE

(75) Inventors: Stefan Hammerstingl, Munich (DE); Holger Cecchin, Puchheim (DE); Dieter Kraus, Schwabmuenchen (DE); Johann Augustin, Munich (DE); Uto Plank, Freising (DE)

(73) Assignee: Hilti Aktiengesellschaft, Schaan (LI)

( * ) Notice: Subject to any disclaimer, the term of this patent is extended or adjusted under 35 U.S.C. 154(b) by 394 days.

(21) Appl. No.: 12/228,752

(22) Filed: Aug. 14, 2008

(65) Prior Publication Data

US 2009/0120770 A1 May 14, 2009

(30) Foreign Application Priority Data

Nov. 9, 2007 (DE) ..... 10 2007 000 454

(51) Int. Cl.
*H01H 9/06* (2006.01)

(52) U.S. Cl. ..... 200/332.2; 200/337

(58) Field of Classification Search ..... 200/331, 200/332.2, 337, 522

See application file for complete search history.

(56) References Cited

U.S. PATENT DOCUMENTS

| | | | | | |
|---|---|---|---|---|---|
| 2,919,332 | A | * | 12/1959 | Descarries | 200/332.2 |
| 3,260,826 | A | * | 7/1966 | Johnson | 200/332.2 |
| 4,174,473 | A | * | 11/1979 | Brenneman | 200/332.2 |
| 4,198,721 | A | * | 4/1980 | Copeland | 15/50.1 |
| 4,900,881 | A | * | 2/1990 | Fischer | 200/61.85 |

FOREIGN PATENT DOCUMENTS

| | | | |
|---|---|---|---|
| DE | 19942156 | A1 * | 3/2001 |
| DE | 10259569 | A1 * | 7/2004 |
| JP | 2002079477 | A * | 3/2002 |

* cited by examiner

*Primary Examiner*—Renee Luebke
*Assistant Examiner*—Lisa Klaus
(74) *Attorney, Agent, or Firm*—Abelman, Frayne & Schwab

(57) ABSTRACT

An electrical hand-held power tool includes an assembly (2) vibrating along a vibration axis (A) during operation of the power tool, at least one, transversely projecting, vibration-decoupled pivotal side handle (3), a manual switch (4) having an actuation element (5) arranged in the side handle (3) and switchingly connectable with at least one sensor switch (8) which is located in the assembly (2) in vicinity of the handle pivot point (G), by a switching rod (7) having a switching element (6) and being pivotally supported on the side handle at a switching pivot point (S) spaced from the handle pivot point (G) and from the vibration axis (A).

4 Claims, 4 Drawing Sheets

PERCUSSION HAND-HELD POWER TOOL WITH CONTACTLESS MANUAL SWITCH LOCATED IN SIDE HANDLE

BACKGROUND OF THE INVENTION

1. Field of the Invention

The present invention relates to a percussion hand-held power tool such as chisel hammer or combination hammer and having a contactless manual switch located in the tool side handle.

2. Description of the Prior Art

In electrical hand-held power tools which are subjected, because of their intended use, to both high dust load and strong vibrations, mechanical contact switches undergo excessive wear.

U.S. Pat. No. 5,014,793 discloses an electrical hand-held power tool that is controlled by a manual switch actuation means of which actuates mechanical piezosensors for controlling a power switch. The pressure sensors are necessarily arranged in a mechanical contact with the actuation means. Therefore, the vibrations are transmitted to the actuation means.

German Publication DE 199 42 156 discloses a combination hammer having a contactless rotary switch which is associated, in a control manner, with a Hall sensor switch with which it is connected by a displaceable switching rod with a permanent magnet. As both the Hall sensor switch and the rotary actuation means are connected with one and the same housing, there are no relative vibrations that can adversely affect the switching process.

German Publication DE 102 59 569 discloses an electrical hand-held power tool having a vibrating assembly that vibrates along a vibration axis, a contactless electrical manual switch with actuation means located in a vibration decoupled main handle, and a sensor switch. The sensor switch is connected vibration-free with a switching means carrier with a permanent magnet The switching means carrier is pivotable in the direction transverse to the vibration axis by pivotal movement transmitting means axially displaceable along the vibration axis within certain limits in response to a manual actuation of the actuation means. This solution is cannot be used in power tools with a side vibration-decoupled handle that extends transverse to the vibration axis.

Japanese Publication JP 200279477 discloses an electrical hand-held power tool having an assembly vibrating along a vibration axis, two, extending transverse to the vibration axis, vibration-decoupled, side handles pivotal about a handle pivot point, and a manual switch with axially actuatable actuation means and provided on one of the handles.

An object of the present invention is an electrical hand-held power tool having a contactless electrical manual switch in a side handle and which is insensitive to vibrations.

SUMMARY OF THE INVENTION

This and other objects of the present invention, which will become apparent hereinafter, are achieved by providing an electrical hand-held power tool, including an assembly set in vibration along a vibration axis during operation of the power tool, at least one, transversely projecting, vibration-decoupled side handle pivotal about a handle pivot point, a manual switch having actuation means arranged in the side handle, a displaceable switching rod for switchingly connecting the actuation means with at least one sensor switch located in the assembly in vicinity of the handle pivot point, with the switching rod having switching means and being pivotally supported on the side handle at a switching pivot point spaced from the handle pivot point and from the vibration axis.

With a lever mechanism formed by provision of a switching pivot point in the pivotal handle, only axial actuation of the actuation means insures a sufficiently large displacement of the switching means relative to the sensor switch and which is necessary for switching. An axial pivoting of the entire side handle is not necessary.

Advantageously, the switching pivot point is located in a middle third between the handle pivot point and the actuation means. Thereby, the axial displacement of the actuation means approximately corresponds to the axial displacement of the switching means.

Advantageously, the sensor switch is formed as a Hall sensor switch, and the switching means is formed as a permanent magnet. This insures provision of a robust and dust-insensitive contactless electrical manual switch.

Advantageously, the switching means is associated with two sensor switches arranged on opposite sides of the switching means and spaced therefrom in a direction transverse to a switching direction. With two sensor switches and in connection with a corresponding switching logic, a redundant switching system is realized.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
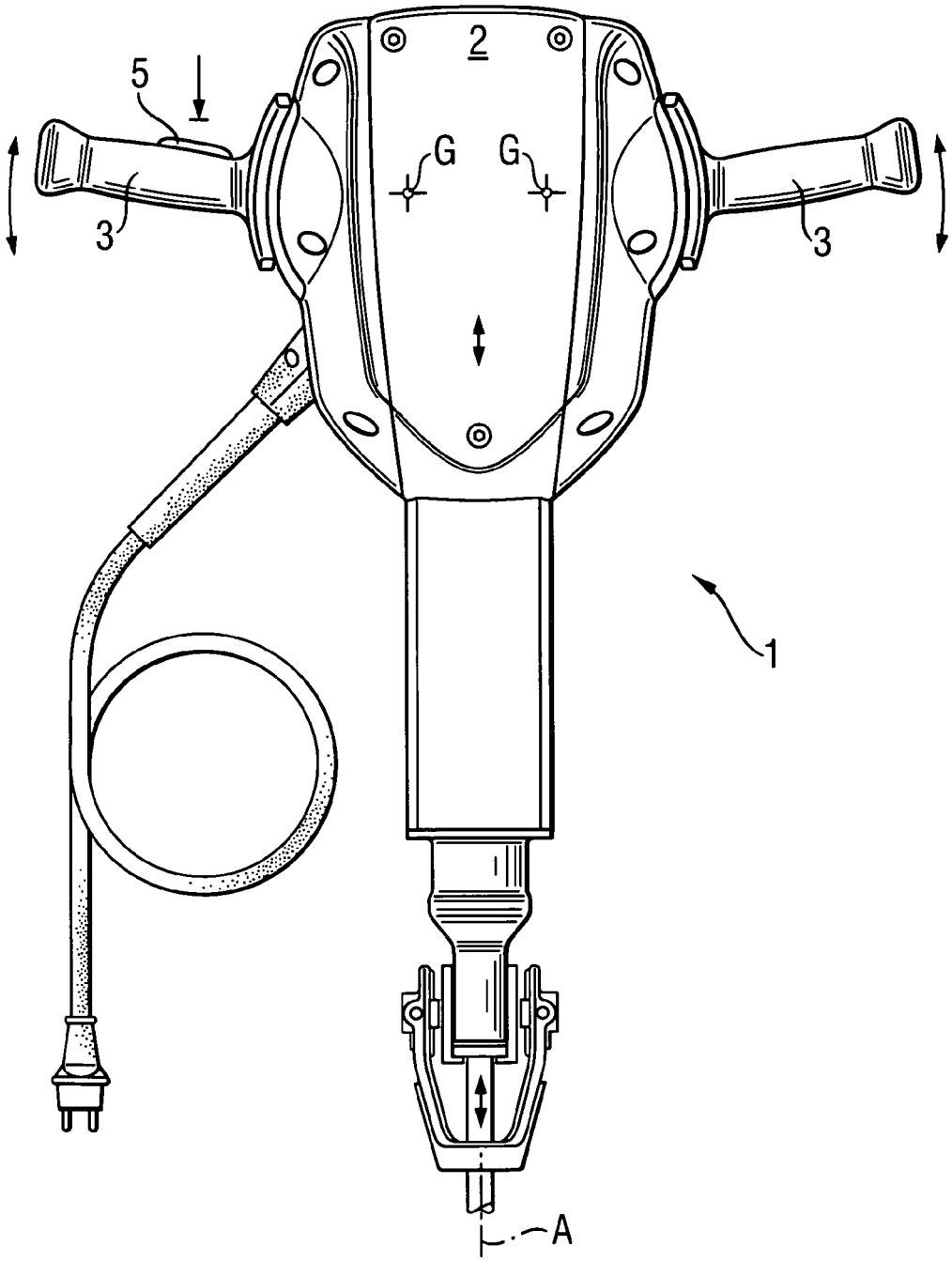
FIG. 1 a front elevational view of a hand-held power tool according to the present invention.

An electrical hand-held power tool according to the present invention, which is shown in FIG. 1 and which is formed as a chisel hammer, includes an assembly 2 that vibrates along a vibration axis A, and two vibration-decoupled side handles 3 which extend transverse to the vibration axis A. Each of the side handles 3 is pivotable about a pivot point G. One of the handles 3 has manually axially actuatable actuation means 5 of a contactless electrical manual switch 4 (FIG. 2).

Figure 2:
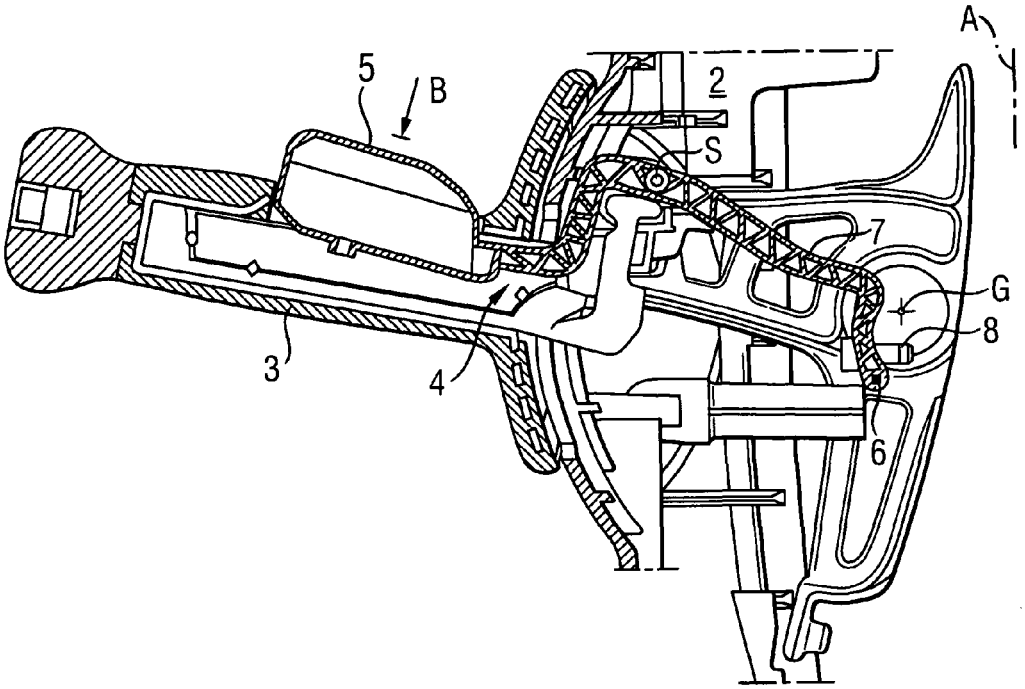
FIG. 2 a cross-sectional longitudinal view of a detail of the power tool shown in FIG. 1 in an upper pivot position without actuation.

As shown in FIG. 2, the actuation means 5 of the manual switch 4, which is provided on the handle 3, is switchingly connected with a sensor switch 8, which is arranged in the assembly 2 in vicinity of the pivot point G of the handle 3, by a displaceable switching element 6. The switching rod 7 is pivotally supported in the side handle 3 at a switch pivot point S that is arranged transverse to the vibration axis A in a middle third between the handle pivot point G and the actuation means 5.

Figure 3:
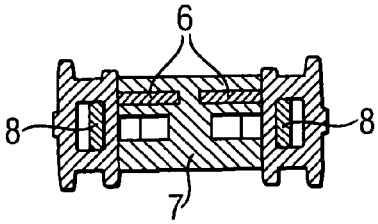
FIG. 3 a longitudinal cross-sectional view of the sensor switch along line III-III in FIG. 4.

According to FIG. 3, the sensor switch 8 is formed as integrated Hall sensor switch, and the switching element 6 is formed as a permanent magnet embedded in the switching rod 7. The switching element 6 is associated with two sensor switches 8 arranged on opposite sides of the switching element 6 and spaced therefrom transverse to the pivotal movement of the switching rod 7.

Figure 4:
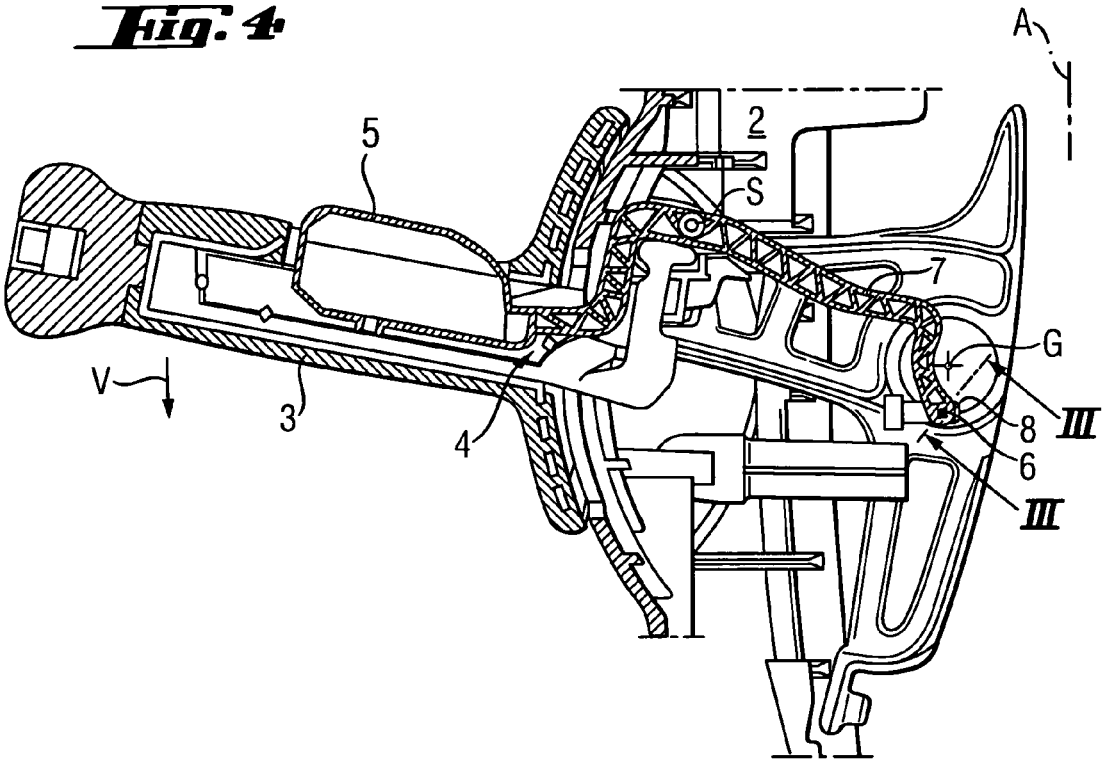
FIG. 4 a cross-sectional longitudinal view of a detail of the power tool shown in FIG. 1 in an upper pivot position with actuation.
Figure 5:
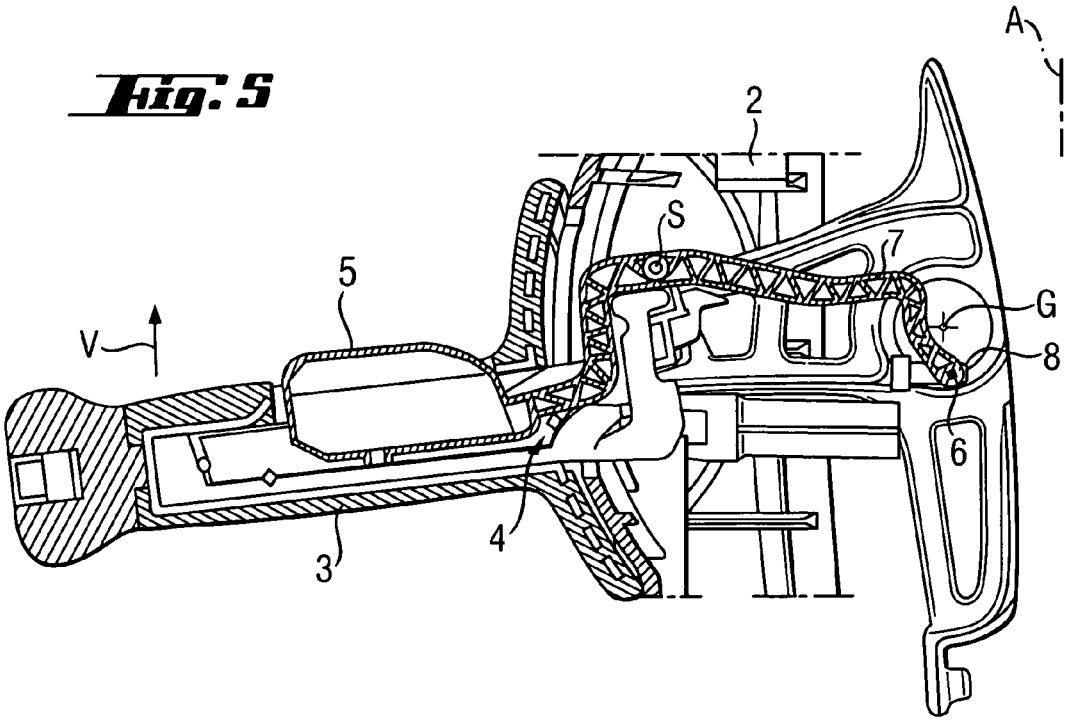
FIG. 5 a cross-sectional longitudinal view of a detail of the power tool shown in FIG. 1 in a lower pivot position with actuation.
Figure 6:
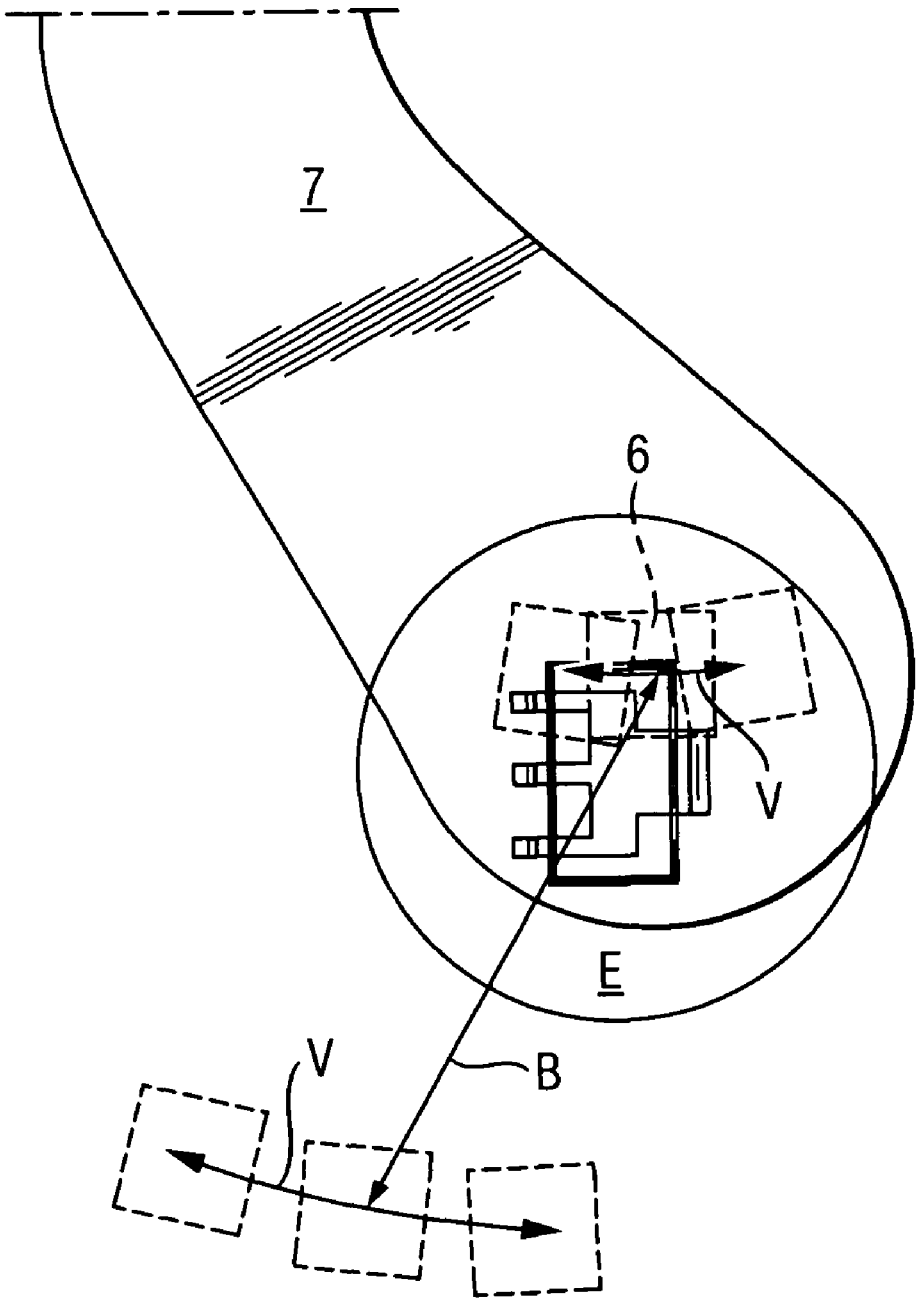
FIG. 6 a schematic view illustrating displacement of the switching element in a displacement plane.

According to FIG. 6, at a pivotal movement of the switching rod 7 (shown only once) with the switching element 6 (shown in different limited displacement positions) relative to the sensor switch 8 with a switch-on region E, the only axial actuation B of the actuation means 5 (FIG. 2) provides for displacement sufficiently large for switching on. The axial pivotal movement V of the side handle 3 alone (FIGS. 4, 5) cannot cause any displacement of the switching element 6 out of the switch-on region E necessary for switching off (FIG. 2).

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An electrical hand-held power tool, comprising an assembly (2) set in vibration along a vibration axis (A) during operation of the power tool; at least one, transversely projecting, vibration-decoupled side handle (3) pivotal about a handle pivot point (G); a manual switch (4) having actuation means (5) arranged in the side handle (3); a displaceable switching rod (7) for switchingly connecting the actuation means (5) with at least one sensor switch (8) located in the assembly in vicinity of the handle pivot point (G), the switching rod (7) having switching means (6) and being pivotally supported on the side handle at a switching pivot point (S) spaced from the handle pivot point (G) and from the vibration axis (A).

2. An electrical hand-held power tool according to claim 1, wherein the switching pivot point (S) is located in a middle third between the handle pivot point (G) and the actuation means (5).

3. An electrical hand-held power tool according to claim 1, wherein the sensor switch (8) is formed as a Hall sensor switch, and the switching means (6) is formed as a permanent magnet.

4. An electrical hand-held power tool according to claim 1 further comprising a further sensor switch (8) associated with the switching means (6), the at least one sensor switch (8) and the further sensor switch (8) being arranged on opposite sides of the switching means (6) and being spaced therefrom in a direction transverse to a switching direction.

* * * * *